US007134415B2

(12) United States Patent
Burke et al.

(10) Patent No.: US 7,134,415 B2
(45) **Date of Patent: *Nov. 14, 2006**

(54) VEHICLE WITH SWITCHED SUPPLEMENTAL ENERGY STORAGE SYSTEM FOR ENGINE CRANKING

(75) Inventors: James O. Burke, Richmond, IL (US); Dean R. Solberg, Mundelein, IL (US)

(73) Assignee: Kold Ban International, Ltd., Lake in the Hills, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/029,659

(22) Filed: Jan. 5, 2005

(65) Prior Publication Data

US 2005/0224035 A1 Oct. 13, 2005

Related U.S. Application Data

(63) Continuation-in-part of application No. 10/764,990, filed on Jan. 26, 2004, now Pat. No. 6,871,625.

(51) Int. Cl.
*F02N 11/08* (2006.01)

(52) U.S. Cl. ..... 123/179.3; 290/38 R

(58) Field of Classification Search ..... 123/179.3, 123/179.1, 179.24; 290/38 R
See application file for complete search history.

(56) References Cited

U.S. PATENT DOCUMENTS

| | | | |
|---|---|---|---|
| 2,659,042 | A | 11/1953 | Anderson |
| 3,638,108 | A | 1/1972 | Channing |
| 3,942,027 | A | 3/1976 | Fima |
| 4,161,682 | A | 7/1979 | Corvett |
| 4,488,147 | A | 12/1984 | Signorile |
| 4,492,912 | A | 1/1985 | Nowakowski |
| 4,494,162 | A | 1/1985 | Eyler |
| 4,510,431 | A | 4/1985 | Winkler |

(Continued)

FOREIGN PATENT DOCUMENTS

| | | |
|---|---|---|
| JP | 2-175351 | 7/1990 |

OTHER PUBLICATIONS

Charge All Wheel Type Battery Chargers (Model 13-012 Boost All, Good All Mfg. 1999).

(Continued)

*Primary Examiner*—Stephen K. Cronin
*Assistant Examiner*—Arnold Castro
(74) *Attorney, Agent, or Firm*—Brinks Hofer Gilson & Lione

(57) ABSTRACT

An engine cranking system includes an engine, a cranking motor coupled to the engine, a battery coupled to the cranking motor and to a system ground and a capacitor. First and second electrical paths interconnect the capacitor with the cranking motor and the system ground. The system further includes first and second switches and a first relay included in one of the first or second electrical paths. The first relay is moveable between at least a closed-circuit position, wherein the first relay completes one of the first and second electrical paths, and an open-circuit position, wherein the first relay interrupts one of the first and second electrical paths. The first switch is coupled between the first relay and the capacitor. A second relay is coupled to the second switch and is moveable between at least a closed-circuit position, wherein the second relay completes a third electrical path activating the cranking motor, and an open-circuit position, wherein the second relay interrupts the third electrical path preventing cranking of the cranking motor.

22 Claims, 5 Drawing Sheets

U.S. PATENT DOCUMENTS

| | | | | |
|---|---|---|---|---|
| 4,540,929 | A | 9/1985 | Binkley | |
| 4,727,306 | A | 2/1988 | Misak et al. | |
| 4,857,820 | A | 8/1989 | Tompkins et al. | |
| 4,902,955 | A | 2/1990 | Manis et al. | |
| 4,949,684 | A | 8/1990 | Gohara | |
| 5,039,930 | A | 8/1991 | Collier et al. | |
| 5,077,513 | A | 12/1991 | Dea et al. | |
| 5,146,095 | A | 9/1992 | Tsuchiya et al. | |
| 5,155,373 | A | 10/1992 | Tsuchiya et al. | |
| 5,155,374 | A * | 10/1992 | Shirata et al. | 290/38 R |
| 5,157,267 | A | 10/1992 | Shirata et al. | |
| H1172 | H | 4/1993 | Gorniak | |
| 5,207,194 | A | 5/1993 | Clerici | |
| 5,260,637 | A | 11/1993 | Pizzi | |
| 5,321,389 | A | 6/1994 | Miester | |
| 5,371,455 | A | 12/1994 | Chen | |
| 5,563,454 | A | 10/1996 | Araki et al. | |
| 5,589,292 | A | 12/1996 | Rozon | |
| 5,637,978 | A | 6/1997 | Kellet et al. | |
| 5,642,696 | A | 7/1997 | Matsui | |
| 5,783,872 | A | 7/1998 | Blair | |
| 5,793,185 | A | 8/1998 | Prelec et al. | |
| 5,818,115 | A | 10/1998 | Nagao | |
| 5,925,938 | A | 7/1999 | Tamor | |
| 5,963,417 | A | 10/1999 | Anderson et al. | |
| 5,998,961 | A | 12/1999 | Brown | |
| 6,018,199 | A | 1/2000 | Shiroyama et al. | |
| 6,034,492 | A | 3/2000 | Saito et al. | |
| 6,057,667 | A | 5/2000 | Mills | |
| 6,075,331 | A | 6/2000 | Ando et al. | |
| 6,130,519 | A | 10/2000 | Whiting et al. | |
| 6,133,645 | A | 10/2000 | Scribner et al. | |
| 6,160,373 | A | 12/2000 | Dunn et al. | |
| 6,163,088 | A | 12/2000 | Codina et al. | |
| 6,211,577 | B1 | 4/2001 | Alksnat et al. | |
| 6,212,054 | B1 | 4/2001 | Chan | |
| 6,222,342 | B1 | 4/2001 | Eggert et al. | |
| 6,242,887 | B1 | 6/2001 | Burke | |
| 6,265,851 | B1 | 7/2001 | Brien et al. | |
| 6,325,035 | B1 | 12/2001 | Codina et al. | |
| 6,362,595 | B1 | 3/2002 | Burke | |
| 6,426,606 | B1 | 7/2002 | Purkey | |
| 6,679,212 | B1 | 1/2004 | Kelling | |
| 2002/0023605 | A1 * | 2/2002 | Osada et al. | 123/179.1 |
| 2003/0075134 | A1 | 4/2003 | Burke | |

OTHER PUBLICATIONS

The Intra Switch, Intra USA 1998.

Battery Optimizer, Purkey's Fleet Electric Inc. 1999.

Low Voltage Disconnects Switches and Alarms, Sure Power Industries Inc. 1998.

U.S. Appl. No. 09/802,284, filed May 1, 2001, entitled "Vehicle with Switched Supplemental Energy System for Engine Cranking."

U.S. Appl. No. 60/292,791, filed May 22, 2001, entitled "Vehicle with Switched Energy Storage System for Engine Cranking."

U.S. Appl. No. 09/652,686, filed Aug. 31, 2000, entitled "Vehicle with Supplemental Energy Storage System for Engine Cranking."

U.S. Appl. No. 10/085,427, filed Feb. 28, 2002, Inventors: Burke and Solberg.

U.S. Appl. No. 09/838,005, filed Apr. 18, 2001, Inventor: James O. Burke.

Miller et al., SAE Technical Paper Series 982794 entitled "Truck Starting Using Electrochemical Capacitors," copyrighted 1998, pp. 1-7.

Miller, John R., "Engineering Battery Capacitor Combinations in High Power Applications: Diesel Engine Starting," presented at "The 9th International Seminar on Double Layer Capacitors and Similar Energy Storage Devices," Deerfield Beach, Florida, pp. 1-11, Dec. 6-8, 1999.

KBi KAPower "Installation-Operation Manual," KBi/Kold-Ban International, Ltd., KBi Form #131137 Rev. 06/00, pp. 1-11,2000.

KBi, "KBi Kranking Kap Super Capacitors," KBi Publication, 2000, 2 pages.

"KAPower Super Capacitors," Kold-Ban International, Ltd., brochures, 2000, 2 pages.

KBi, "KrankingKart Professional Jump-Start Unit," obtained at the internet address: http://www.koldban.com/mainpages/karts.htm, Aug. 30, 2001, 3 pages.

Capacitor Log, May 15, 2000, Kold Ban Intl. Ltd., 4 pages.

* cited by examiner

67
Acc
START OFF
ON/RUN
65
OFF
ON/RUN
12
S
TERM.
16
20
B
TERM.
21
64
62
110
102
104
60
18
106
108
112
60
21
21
60
63
48
38
42
44
32
34
40
+
30
−
46
36

VEHICLE WITH SWITCHED SUPPLEMENTAL ENERGY STORAGE SYSTEM FOR ENGINE CRANKING

This application is a continuation-in-part of U.S. patent application Ser. No. 10/764,990, filed Jan. 26, 2004 now U.S. Pat. No. 6,871,625, the entire disclosure of which is hereby incorporated by reference.

BACKGROUND

The present invention relates to vehicles of the type that include an internal combustion engine, a cranking motor, and a battery normally used to power the cranking motor. In particular, this invention relates to improvements to such systems that increase of the reliability of engine starting.

A problem presently exists with vehicles such as heavy-duty trucks. Drivers may on occasion run auxiliary loads excessively when the truck engine is not running. It is not unusual for heavy-duty trucks to include televisions and other appliances, and these appliances are often used when the truck is parked with the engine off. Excessive use of such appliances can drain the vehicle batteries to the extent that it is no longer possible to start the truck engine.

Various systems have been developed that use a capacitor to supplement the vehicle batteries such that the vehicle can be started. Often, however, the capacitor is not completely isolated, and can lose its charge over time, for example by leaking through one or more diodes. In other systems, wherein the capacitor is completely isolated when not in use, the capacitor is also isolated from the one or more switches or relays used to connect the capacitor to the cranking motor, such that the capacitor cannot be used to close the switch or relay to bring the capacitor on line.

SUMMARY

In one aspect, an engine cranking system includes an engine, a cranking motor coupled to the engine and a battery having first and second battery terminals. The first battery terminal is electrically coupled to the cranking motor and the second battery terminal is electrically coupled to a system ground. A capacitor includes first and second capacitor terminals. First and second electrical paths interconnect the first and second capacitor terminals, respectively, with the cranking motor and the system ground. First and second switches include first and second sets of switch terminals respectively. The first set of switch terminals is coupled between the first battery terminal and the cranking motor. A relay is included in one of the first and second electrical paths and has first and second control terminals. The second set of switch terminals is coupled between one of the first and second capacitor terminals and the second control terminal. The other of the first and second capacitor terminals is electrically coupled with the first control terminal. The relay is moveable between at least a closed-circuit position, in which the relay completes one of the first and second electrical paths, and an open-circuit condition, in which the relay interrupts one of the first and second electrical paths.

In one preferred embodiment, the relay is included in the second electrical path, wherein the second set of switch terminals is coupled between the second capacitor terminal and the second control terminal, and wherein the first capacitor terminal is electrically coupled with the first control terminal. In one preferred embodiment, the first and second switches are configured as a double pole, single-throw switch. In an alternative embodiment, the relay is included in the first electrical path.

In one aspect, a running engine sensory component is coupled between one of the system ground and the first battery terminal and one of the first and second control terminals. The running engine sensory component maintains the relay in the closed-circuit position when the engine is operated in the running condition. In one embodiment, the running engine sensory component includes a normally open oil pressure switch that is electrically coupled between the system ground and the second control terminal. The normally open oil pressure switch is positionable in a closed position in response to at least a predetermined minimum oil pressure being applied thereto.

In another aspect, a method of starting an engine includes simultaneously closing the first and second switches, applying a control voltage to the relay with the capacitor through the second switch, and positioning the relay in the closed-circuit condition in response to the control voltage being applied thereto and thereby completing one of the first and second electrical paths.

In yet another aspect, an engine cranking system includes an engine, a cranking motor coupled to the engine, a battery coupled to the cranking motor and to a system ground and a capacitor. First and second electrical paths interconnect the capacitor with the cranking motor and the system ground. The system further includes first and second switches and a first relay included in one of the first and second electrical paths. The first relay is moveable between at least a closed-circuit position, wherein the first relay completes one of the first and second electrical paths, and an open-circuit position, wherein the first relay interrupts one of the first and second electrical paths. The first switch is coupled between the first relay and the capacitor. A second relay is coupled to the second switch and is moveable between at least a closed-circuit position, wherein the second relay completes a third electrical path activating the cranking motor, and an open-circuit position, wherein the second relay interrupts the third electrical path preventing cranking of the cranking motor.

The various preferred embodiments provide significant advantages over other engine cranking systems. In particular, the capacitor is completely isolated when the ignition switch is not in the start position. Accordingly, the capacitor cannot be inadvertently discharged, and it cannot leak over time, for example, through a diode. Moreover, the capacitor can be brought on line to close the relay simply by moving the switch to the start position. Accordingly, the system avoids inadvertent discharge while also making the capacitor available to close the relay.

This section has been provided by way of general introduction, and it is not intended to narrow the scope of the following claims.

DETAILED DESCRIPTION OF THE PREFERRED EMBODIMENTS

Figure 1:
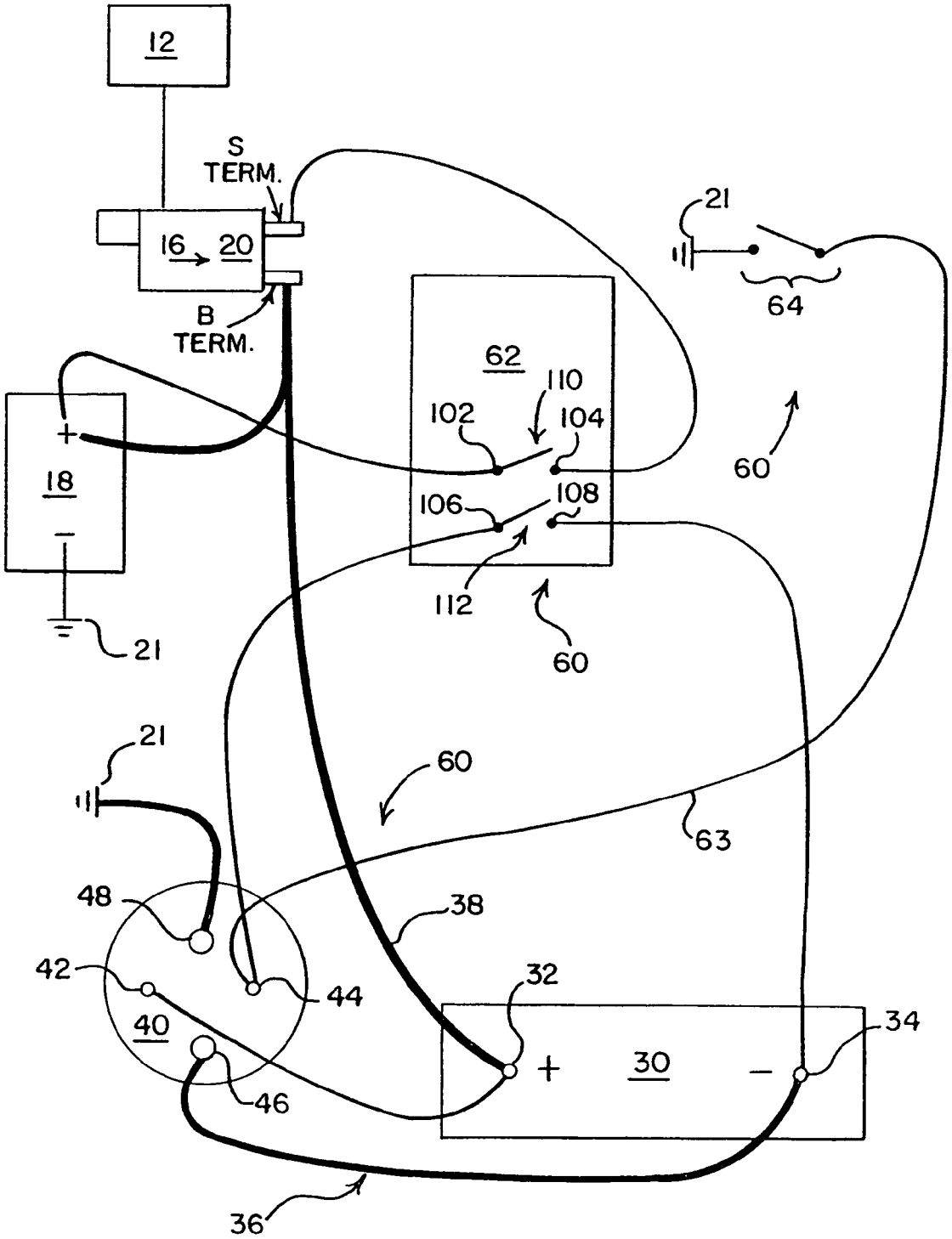
FIG. 1 is a schematic diagram of a first embodiment of a vehicle electrical system that incorporates a preferred embodiment of this invention, showing an ignition switch in the open position and an oil pressure switch in an open position, with a relay in an open-circuit condition.

Turning down to the drawings, FIGS. 1–5 show an electrical system of a vehicle (not shown) that includes an internal combustion engine 12. The engine 12 can take any suitable form, and may for example be a conventional diesel or gasoline engine. The engine 12 is mechanically coupled to a cranking motor 16. The cranking motor 16 can take any suitable form, and it is conventionally an electrical motor that is powered during cranking conditions by current from one or more storage batteries 18 such as conventional lead-acid batteries. Current from the batteries 18 is switched to the cranking motor 16 via a switch such as a conventional solenoid switch 20. In operation, the engine is operably moved between a running condition and an off condition.

All of the elements 12 through 20 described above may be entirely conventional, and are well-known to those skilled in the art. The present invention is well adapted for use with the widest variety of alternative embodiments of these elements.

In addition to the conventional electrical system described above, the vehicle also includes a supplemental electrical system including a capacitor 30. The capacitor 30 is preferably a double layer capacitor of the type known in the art as an electrochemical capacitor. Suitable capacitors may be obtained from KBI, Lake in the Hills, IL under the trade name KAPower. For example, in one alternative embodiment, the capacitor 30 has a capacitance of 1000 farads, a stored energy capacity of 60 kilojoules, an internal resistance at −30 degrees Celsius of 0.003 ohms, and a maximum storage capacity of 17.5 kilowatts. In general, the capacitor should have a capacitance greater than 150 farads, and an internal resistance at 20° C. that is preferably less than 0.008 ohms, more preferably less than 0.006 ohms, and most preferably less than 0.003 ohms. The energy storage capacity is preferably greater than 15 kJ. Such capacitors provide the advantage that they deliver high currents at low temperatures and relatively low voltages because of their unusually low internal resistance. Further information about suitable capacitors for use in the system of FIGS. 1–3 can be found in publications of ESMA, Troitsk, Moscow region, Russia and on the Internet at www.esma-cap.com.

The capacitor 30 includes a positive terminal 32 and a negative terminal 34. The positive terminal 32 is connected with the cranking motor via an electrical path 38 that includes a suitable cable and the solenoid switch 20. The negative terminal 34 is connected to system ground 21 by another electrical path 36 that includes suitable cables and a relay 40. The relay 40 includes first and second control terminals 42, 44 and first and second switched terminals 46, 48. The switched terminals 46, 48 are included in the electrical path 36 such that the relay 40 interrupts the electrical path 36 when the relay is in an open-circuit condition. The relay 40 completes the electrical path 36 when the relay is in a closed-circuit condition.

The relay 40 may take many forms, and may include an electromechanical switch or a solid-state switch. By way of example, a 500 amp, 12 volt electromechanical relay can be used such as that supplied by Kissling as part number 29.511.11. As an example of a suitable solid-state relay, the MOSFET switch sold by Intra USA under the trade-name Intra Switch can also be used.

The relay 40 is controlled (e.g., closed) by a first portion of a control circuit 60 that applies a voltage between the control terminals 42 and 44. In one embodiment, the first portion of the control circuit is coupled between the positive and negative terminals 32, 34 of the capacitor. The relay 40 can also be controlled or closed by another portion of the control circuit 60 extending between the positive terminal of the battery 18 and ground 21, which circuit is defined at least in part by the electrical path from the positive terminal of the battery to the B terminal, from the B terminal to the positive terminal 32 of the capacitor and from the positive terminal 32 of the capacitor to the relay control terminal 42. The second portion of the control circuit 60 is completed by the electrical path across the relay control terminals 42, 44 to ground 21 through a running engine sensory component 64.

Figure 2:
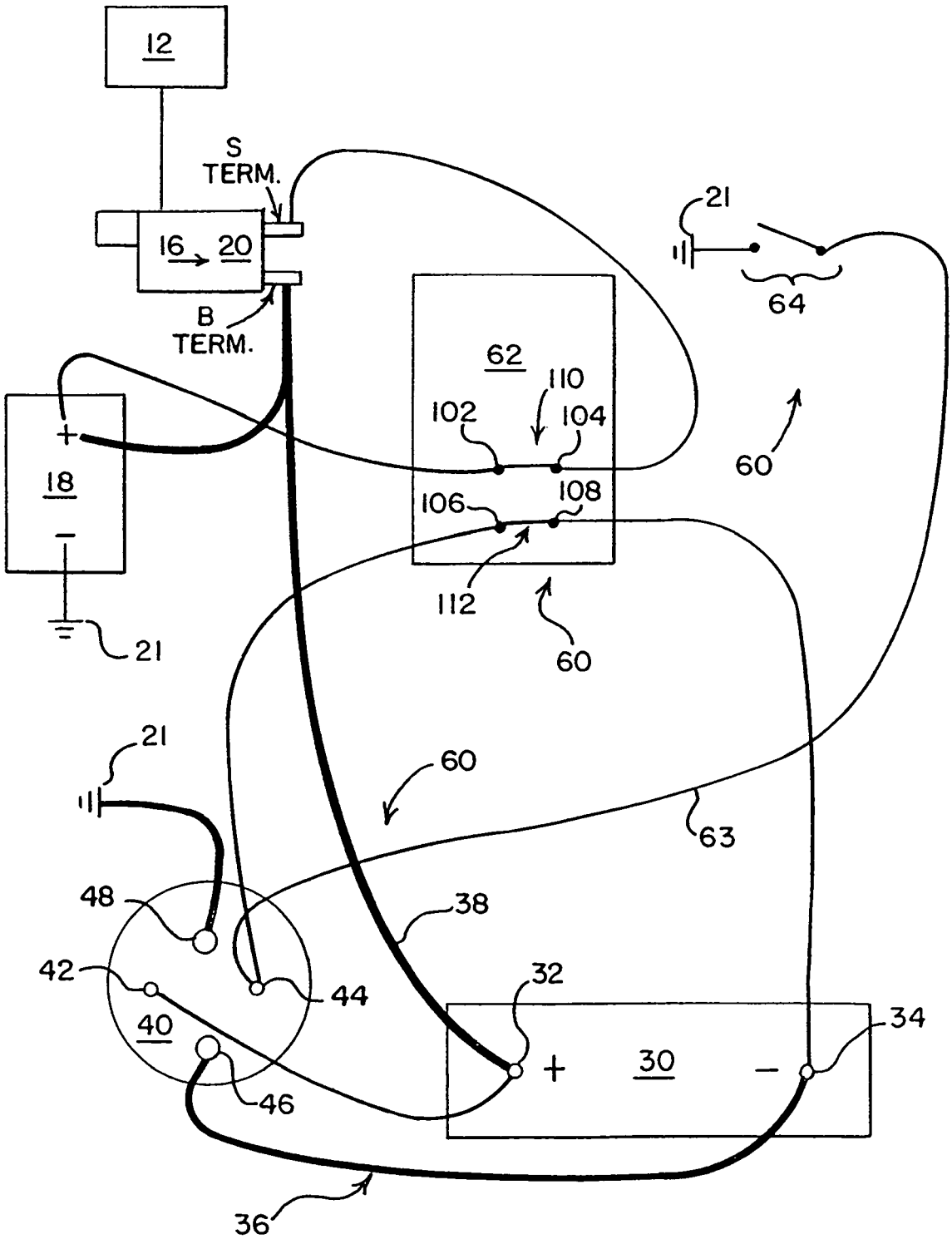
FIG. 2 is a schematic diagram of the system of FIG. 1, showing the ignition switch in a closed position and the oil pressure switch in the open position, with the relay in a closed-circuit condition.

As shown in FIGS. 1–2, the first portion of the control circuit 60 includes a first switch 110 that is preferably configured as part of the ignition switch 62 of the vehicle. A conventional ignition switch includes four positions: accessory, off, on/run, and start. Of course, in other embodiments, other switches having other positions can be used. In addition, in some embodiments, a switch can be positioned between at least an off and run position, and a separate push-button, crank switch is actuated to crank the motor. In such an embodiment, one or both of the off/run switch and the separate push-button switch are defined as an ignition switch.

Figure 3:
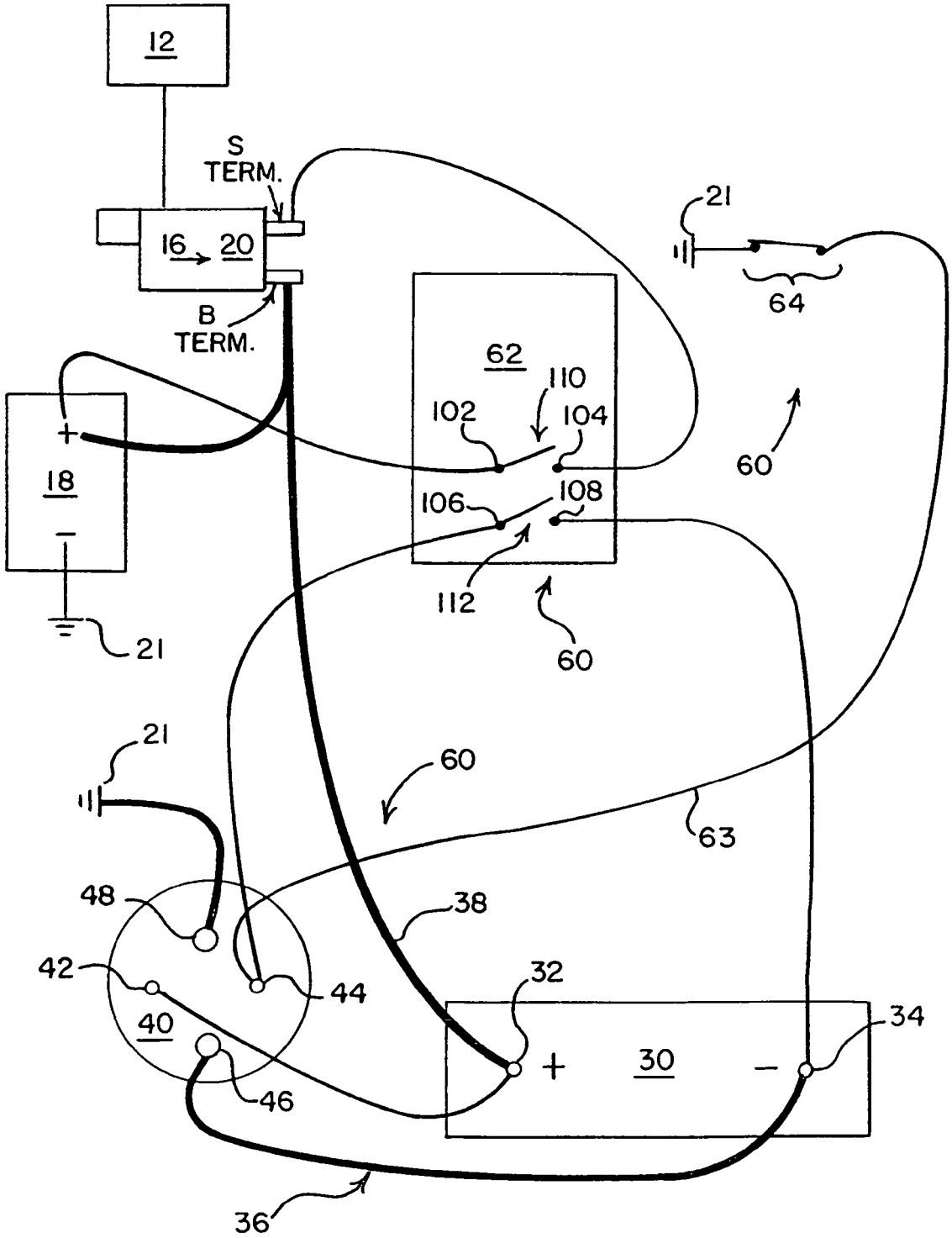
FIG. 3 is a schematic diagram of the system of FIG. 1, showing the ignition switch in an open position and the oil pressure switch in a closed position, with the relay in a closed-circuit condition.
Figure 4:
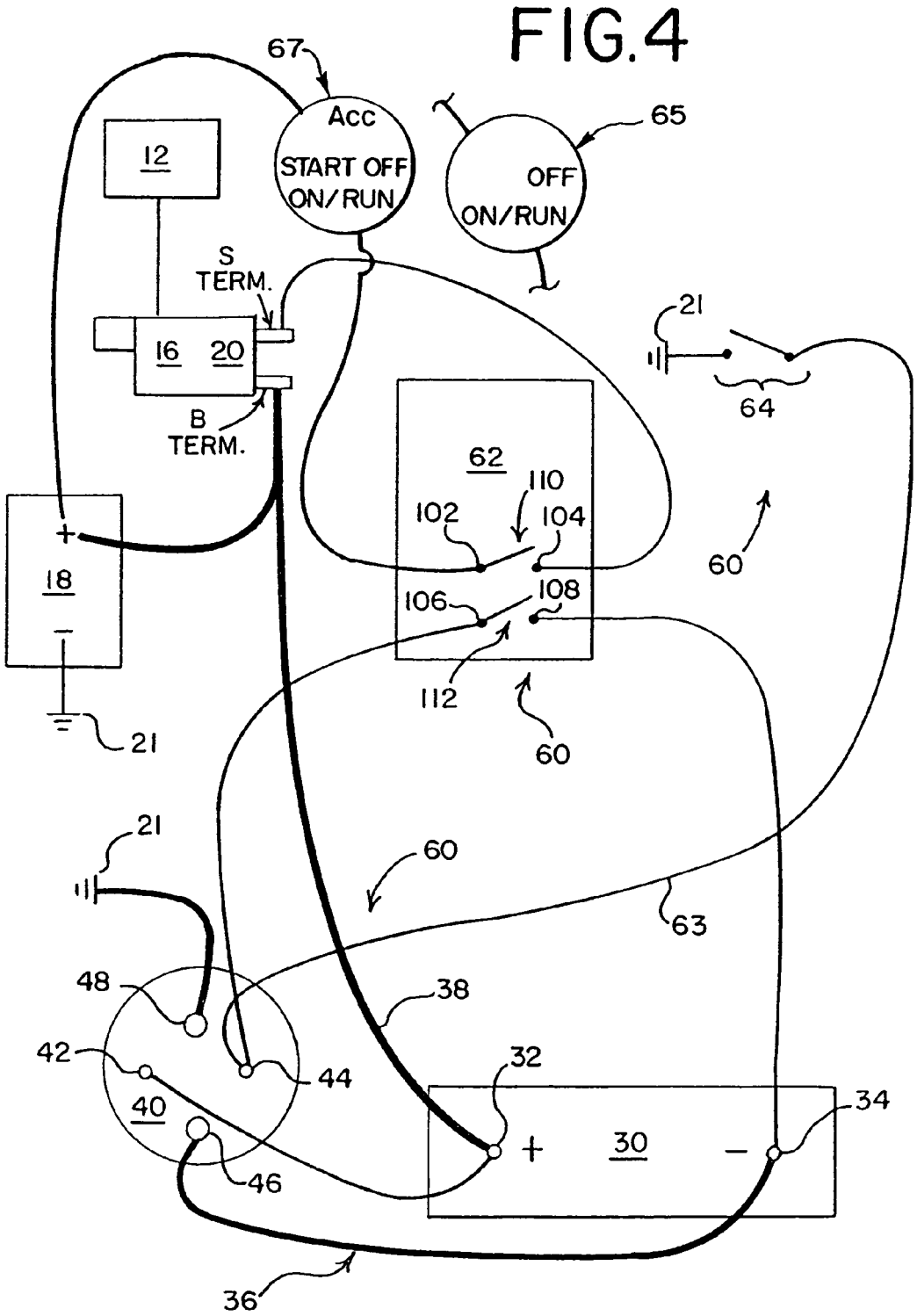
FIG. 4 is a schematic diagram of a second embodiment of a vehicle electrical system that incorporates a preferred embodiment of this invention, showing an ignition switch in the open position, with the relay in an open-circuit condition.

In one embodiment, shown in FIGS. 1–3, the ignition switch 62 is configured as a single proprietary double-pole, single throw switch, which closes the switch 110 when moved to a start position. In another embodiment, shown in FIG. 4, the ignition switch includes a double-pole, single throw switch 62 and a conventional ignition switch 67 moveable between the accessory, off and on/run positions (the start position is disabled or rendered inoperative). Alternatively, as shown in FIG. 4, the ignition switch includes the double-pole, single throw switch 62 and another conventional ignition switch 65 moveable between the off and on/run positions. In yet another embodiment, shown in FIG. 5, a relay 200 is coupled between the ignition switch 62 and the solenoid switch 20.

In one embodiment, shown in FIGS. 1–3, the switch 110 has first and second switch terminals 102, 104 electrically connected between the positive terminal of the battery and the S terminal of the cranking motor 16. In the embodiments of FIG. 4, one of the switches 67 or 65 is positioned between the battery and the terminal 102 of the switch 110.

Figure 5:
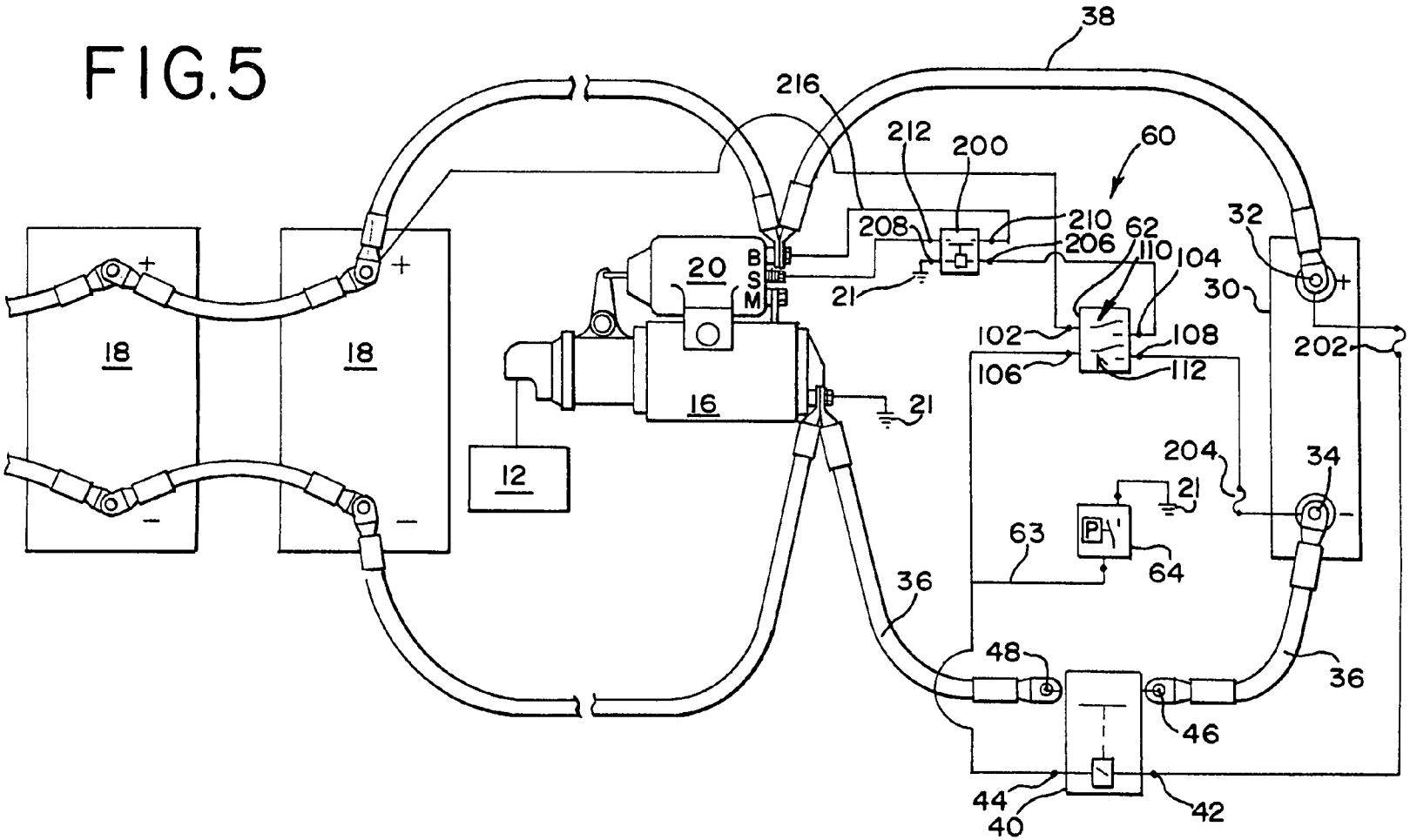
FIG. 5 is a schematic diagram of a third embodiment of a vehicle electrical system that incorporates a preferred embodiment of this invention having a starter relay and showing an ignition switch and oil pressure switch in an open position.

In the embodiment of FIG. 5, a starter relay 200 has a first control terminal 206 electrically connected to the switch terminal 104 and a second control terminal 208 electrically connected to the system ground 21. The relay 200 further includes first and second switched terminals 210, 212 connected between the B and S terminals of the solenoid switch 20. In one embodiment, the relay 200 is located on the opposite side of a firewall (not shown) relative to the cabin of the vehicle, for example in the engine compartment. Relatively high-current, heavy duty cables are connected between the switched terminals 210, 212 of the relay and the B and S terminals of the solenoid switch connected to the cranking motor. Lower current wires or cables are used in the cabin to connect to the control terminals of the relay. For example, one or more of switches 62, 65, 67 can be located in the cabin. In operation, when the switch 110 is closed and the battery has sufficient charge, a control voltage is applied across the control terminals 206, 208 to close the relay 200, or move it to the closed-circuit position. A voltage is then applied across the B and S terminals and the cranking motor 16 is cranked.

In the embodiments of FIGS. 1–5, the control circuit 60 further includes a second switch 112 that is also part of the ignition switch 62. In particular, the first and second switches 110, 112 are configured as part of the double-pole, single-throw switch 62, wherein each switch 110,112 has a proprietary pole. One suitable double-pole, single-throw switch is the Alco Switch Part No. MPG206R. The switch 112 has first and second switch terminals 106, 108 electrically connected between the negative terminal of the capacitor and the control terminal 44 of the relay.

In one embodiment, as shown in FIG. 5, a fuse 202 is located in the electrical path between the terminal 32 of the capacitor 30 and the control terminal 42 of the relay 40. The fuse 202 can be rated, for example and without limitation, at 5 amps. A fuse 204 also is located in the electrical path between the terminal 34 of the capacitor and the switch terminal 108 of the switch 112. The fuse 204 can be rated, for example and without limitation, at 5 amps. The fuses 202, 204 ensure that a maximum current no greater than the rating of the fuse is delivered to the relay 40 and switch 62 in order to protect those components, including the conductors. Of course, it should be understood that one or more fuses (not shown) can also be incorporated as disclosed herein into the embodiments disclosed in FIGS. 1–4.

Referring to FIGS. 1–5, when the switch 112 is closed, the capacitor applies a control signal or control voltage to the relay 40 through the switch 112. In this example, when the switch 112 is closed, the control signal is held at a positive voltage across the control terminals 42, 44 (assuming the capacitor 30 and/or battery 18 are charged), and this positive voltage places the relay 40 in a closed-circuit condition, which places the negative terminal 34 in low-resistance contact with the cranking motor 16, or system ground 21. Alternatively, and referring to FIGS. 1–3, when the switch 112 is open, for example when the ignition switch 62 is in any of the off, on/run or accessory positions, the control signal zero voltage, and the relay 40 is in an open-circuit condition. In this condition the relay 40 interrupts the electrical path 36, thereby isolating the negative terminal 34 of the capacitor 30 from the cranking motor 16, or other system ground.

Referring to FIG. 4, the user places one of the switches 67 or 65, depending on how the vehicle is equipped, in the on/run position. The user then closes the switches 110 and 112, such that the capacitor 30 is brought on line to close the relay 40. In one sequence, when there is insufficient charge in the battery 18 and/or capacitor 30 to crank the motor, the user can maintain and/or place the switches 67, 65 in one of the accessory or off positions and separately close the switch 62, which closes the switches 110, 112 and subsequently the relay 40. Because the switches 67 or 65 are not in the run position, the engine is not cranked. Instead, in this position, the battery 18 is put in parallel with the capacitor and can charge the capacitor 30. Because of the low resistance of the capacitor 30, the capacitor can be charged by the battery to a voltage capable of cranking the engine 12, even if the battery 18, with its high resistance, and the capacitor initially were not able to crank the engine.

If the switches 110, 112 are closed, the user merely turns the switch 67 or 65 to the run position, which will close the circuit and bring the capacitor and battery on line to crank the engine. Alternatively, the user can open the switch 62 and corresponding switches 110, 112, turn the switch 67 or 65 to the on/run position, and then close the switch 62 (including switches 110 and 112) to crank the motor. After the engine is started, the user releases or opens the switch 62 (and the corresponding switches 110, 112). The running engine sensory component 64 will then be operated to maintain the relay 40 in a closed-circuit condition as explained below.

It should be understood that one of the switches 67, 65 of the embodiments shown in FIG. 4 can also be incorporated into the embodiment shown in FIG. 5, for example in the electrical path connecting the battery terminal with the switch terminal 102. In the operation of the embodiment shown in FIG. 5, the switch 110 is closed, whether using the sequence as described above with respect to the embodiment of FIGS. 1–3 or the embodiment of FIG. 4. As the switch 110 is closed, a control voltage is applied across the control terminals 206, 208 of the relay 200 between the positive terminal of the battery 18 and ground 21. The control voltage in turn closes the relay 200, or moves it to a closed-circuit position, which completes the electrical pathway 216 between the B and S terminals and activates the solenoid switch 20 to crank the cranking motor 16. In the open-circuit position, the relay 200 interrupts the electrical pathway 216 and prevents the solenoid switch from being activated and the cranking motor from being cranked.

As set forth above, and with reference to FIGS. 1–5, the control circuit 60 further includes a running engine sensory component 64 electrically connected between the system ground 21 and the control terminal 44 of the relay with a conductor 63. The running engine sensory component 64 senses then the engine is in a running condition and maintains the relay 40 in a closed-circuit condition while the engine is running.

For example, in one embodiment, the running engine sensory component 64 is configured as a normally open oil pressure switch. One suitable oil pressure switch is available from Nason Co., located in West Union, N.C. under Part No. SM-2A-5R. When the oil pressure of the engine 12 rises above a set value, or a minimum predetermined value, for example when the engine is running, the normally open oil pressure switch 64 closes, thereby applying a positive voltage across the control terminals 42, 44 from the battery 18 though the B terminal, electrical path 38 and the path between terminals 32 and 42 to system ground 21. The term "running" as used herein means that the engine crank shaft is turning, for example by way of the cranking motor and/or by way of internal combustion.

In various exemplary preferred embodiments, the minimum predetermined oil pressure is greater than or equal to about 5 psi, alternatively between about 5 psi and about 50 psi, and alternatively between about 10 psi and 30 psi, although it should be understood that it could be a greater or lesser value. When a positive voltage is applied via the conductor across the control terminals 42, 44, the relay 40 is placed in a closed-circuit condition, which completes the circuit and places the negative terminal 34 in low-resistance contact with the cranking motor 16, or system ground 21. Thus, the oil pressure switch 64 closes the relay 40 and connects the capacitor 30 to the electrical system including the batteries 18 throughout the time that the engine 12 is running. This allows the engine alternator (not shown) to recharge the capacitor 30.

Other running engine sensory components include for example and without limitation various switches or devices responsive to pressure/vacuum (e.g., from the manifold), alternator output, and/or revolutions per minute (e.g., flywheel revolutions). In one example, the running engine sensory component includes an Engine Control Module (ECM), which provides a signal that the engine is running, which signal maintains the relay 40 in a closed-circuit condition.

The operation of the system described above will be explained in conjunction with FIGS. 1–3. Though not shown in the Figures, the electrical system of the vehicle includes a conventional generator or alternator driven by the engine when running to charge both the batteries 18 and capacitor 30. FIG. 1 shows the state of the system when the first switch 110 is opened, as for example when the ignition switch 62 of the vehicle is in the off position, the accessory position or the on/run position. When the first switch 110 is opened, the second switch 112, which is connected to the first switch 110 and moves simultaneously therewith, is also opened. As such, the capacitor 30 is isolated from the relay 40, such that it is prevented from discharging, and the relay 40 is in placed in the open-circuit condition. The driver of the vehicle is free to use accessory power as desired, but such usage will at most drain the batteries 18, while leaving the capacitor 30 in a full state of charge.

FIG. 2 shows the state of the system when the ignition switch 62 is moved to the start position. In particular, the first switch 110 component is closed thereby bringing the battery 18 on line to supply power to the cranking motor 16. At the same time, or simultaneously with the first switch component 110, the second switch component 112 is also closed, thereby applying a voltage from the capacitor 30 to the relay control terminals 42, 44 and placing the relay 40 in the closed-circuit condition. In this state, the relay 40 connects the negative terminal 34 and system ground 21, thereby reconnecting the capacitor 30 with the electrical system of the vehicle and making the power stored in the capacitor 30 available for use in engine cranking.

Thereafter, as shown in FIG. 3, the ignition switch 62 is preferably placed in the run position, with the first and second switch components 110, 112 thereby being opened. In this position, the relay 40 is not maintained in the closed-circuit position by the capacitor 30. Rather, for example in one embodiment, as the engine is cranked and started, the oil pressure rises to or above the minimum predetermined oil pressure (e.g., 5 psi) such that the oil pressure switch 64 is closed. Preferably, the oil pressure switch 64 is closed prior to the user placing the ignition switch 62 in the run position. In this way, a voltage is continuously applied across the relay control terminals 42, 44 to maintain the relay 40 in a closed-circuit position, with the control voltage first being applied by the capacitor 30 across the terminals 42, 44 when the switch 112 is closed, and thereafter being applied by the battery 18 or alternator by way of the oil pressure switch 64 to system ground 21. Of course, in other embodiments, running engine sensory components other than an oil pressure switch, as described above, can be used to maintain the relay 40 in the closed-circuit condition while the engine is running. In addition, it should be understood that the running engine sensory components, such as the oil pressure switch, can be positioned in the electrical path connected to the positive terminal of the capacitor, rather than in the path connected to system ground.

In this way, the relay 40 is maintained in the closed-circuit condition and connects the capacitor 30 to the electrical system including the batteries 18 throughout the time that the engine 12 is running, or until the running engine sensory component, e.g. the oil pressure switch 64, is opened, for example when the engine is turned off and the oil pressure falls below the predetermined minimum oil pressure. In this way, the engine alternator (not shown) recharges the capacitor 30 while the engine is running.

Referring to FIGS. 1–3, it should be apparent that the control circuit 60 operates automatically to connect the capacitor 30 with the electrical system of the vehicle while the engine 12 is running and the oil pressure (or other sensory input) is at or above the predetermined level, as well as during periods of engine cranking. This is accomplished without any driver intervention. Also, when the engine is not running and the oil pressure is below the predetermined level, and when the engine is not being cranked, the control circuit 60 automatically causes the relay 40 to open, thereby disconnecting the capacitor 30 from the electrical system of the vehicle. For this reason, the vehicle operator cannot inadvertently drain the capacitor 30 with auxiliary loads, for example when leaving the ignition switch in the run/on position. The driver of the vehicle is free to use accessory power as desired, regardless of whether the ignition switch is in the run position or the accessory position, and such usage will at most drain the batteries 18, leaving the capacitor 30 in a full state of charge.

In particular, though not shown in FIGS. 1–3, the electrical system of the vehicle 10 includes a conventional generator or alternator driven by the engine 12 when running to charge both the batteries 18 and the capacitor 30. Thus, the capacitor 30 is generally fully charged when the engine is shut down. Because the relay 40 is in the open-circuit condition, this state of charge of the capacitor 30 is preserved.

The systems described above provide a number of important advantages. The supplemental electrical system including the capacitor 30 provides adequate current for reliable engine starting, even if the batteries 18 are substantially discharged by auxiliary loads when the engine 12 is not running. If desired, the supplemental electrical system including the capacitor 30 may be made invisible to the user of the vehicle. That is, the vehicle operates in the normal way such that the starting advantages provided by the capacitor 30 are obtained without any intervention on the part of the user. The capacitor is automatically disconnected from the vehicle electrical system when the vehicle is turned off, and automatically reconnected to the vehicle electrical system when the engine is started.

Additionally, the capacitor 30 provides the advantage that it can be implemented with an extremely long-life device that can be charged and discharged many times without reducing its efficiency in supplying adequate cranking current. This system does not interfere with conventional availability of the batteries 18 to power accessories when the engine is off. This reduces the incentive of the vehicle operator to defeat the system. In addition, since the capacitor provides cold cranking amps, the one or more batteries can be selected from suitable "deep cycle," or reserve capacity batteries, which provide increased reserve capacity while providing less cold cranking amps. In this way, the user is provided with increased reserve capacity, for example to run various accessories such a television or radio, while not sacrificing cold starting capability. In addition, the life of the battery is extended.

Referring to the embodiments of FIGS. 1–3, the control system 60 is powered with the stored voltage on the capacitor 30 and/or the batteries 18. Thus, as long as the capacitor 30 includes an adequate charge to start the engine 12, it will provide an adequate voltage to close the relay 40. This is a substantial advantage, because if the control circuit 60 were connected simply between the positive terminal of the capacitor and system ground, a condition might arise in which the batteries 18 stored insufficient charge to close the relay 40, thereby preventing an operator from starting the engine 12 even though adequate charge was available in the capacitor 30.

As used herein, the terms "connected" and "coupled with" are intended broadly to encompass direct and indirect coupling. Thus, first and second elements are said to be coupled with one another whether or not a third, unnamed, element is interposed therebetween. For example, two elements may be coupled with one another by means of a switch.

The term "battery" is intended broadly to encompass a set of batteries including one or more batteries.

The term "set" means one or more.

The term "path" is intended broadly to include one or more elements that cooperate to provide electrical interconnection, at least at some times. Thus, a path may include one or more switches or other circuit elements in series with one or more conductors.

Of course, many alternatives are possible. For example, the relay can be placed in the electrical path that interconnects the positive terminal of the capacitor and the cranking motor or in both electrical paths that interconnect with the capacitor. Various switches and relays can be used to implement the functions described above, and cables and cable terminations can be adapted as appropriate. For example, it is not essential in all embodiments that an engine oil pressure switch be used to indicate when the engine is running. Rather, as explained above, other parameters indicative of engine operation can be used to control the switch 64, including without limitation alternator output, flywheel rotation, manifold pressure/vacuum and/or ECM signals.

The foregoing description has discussed only a few of the many forms that this invention can take. For this reason, this detailed description is intended by way of illustration, not limitation. It is only the claims, including all equivalents, that are intended to define the scope of this invention.

The invention claimed is:

1. An engine cranking system comprising:

an engine operably moveable between a running condition and an off condition;

a cranking motor coupled to said engine;

a battery comprising first and second battery terminals, said first battery terminal electrically coupled to said cranking motor and said second battery terminal electrically coupled to a system ground;

a capacitor comprising first and second capacitor terminals;

first and second electrical paths interconnecting said first and second capacitor terminals, respectively, with said cranking motor and said system ground;

first and second switches comprising first and second sets of switch terminals respectively;

a first relay included in one of said first or second electrical paths and having a first control terminal and a second control terminal, wherein said second set of switch terminals is coupled between one of said first and second capacitor terminals and said second control terminal, and wherein the other of said first and second capacitor terminals is electrically coupled with said first control terminal, and wherein said first relay is moveable between at least a closed-circuit position, in which the first relay completes said one of said first and second electrical paths, and an open-circuit condition, in which the first relay interrupts said one of said first and second electrical paths; and a second relay having first and second control terminals, wherein said first set of switch terminals is coupled between said first battery terminal and said first control terminal of said second relay, and wherein said second control terminal of said second relay is coupled to said system ground, and wherein said second relay comprises a switched terminal coupled to the cranking motor.

2. The engine cranking system of claim 1 wherein said first relay is included in said second electrical path, wherein said second set of switch terminals is coupled between said second capacitor terminal and said second control terminal of said first relay, and wherein said first capacitor terminal is electrically coupled with said first control terminal of said first relay, and wherein said first relay completes said second electrical path when in said closed-circuit position and said first relay interrupts said second electrical path when in said open-circuit position.

3. The engine cranking system of claim 1 wherein said first and second switches comprise a double pole, single-throw switch.

4. The engine cranking system of claim 3 wherein said double pole, single-throw switch forms part of an ignition switch.

5. The engine cranking system of claim 1 further comprising a running engine sensory component coupled between one of said system ground and said first battery terminal and one of said first and second control terminals of said first relay, wherein said running engine sensory component maintains said first relay in said closed-circuit position when said engine is operated in said running condition.

6. The engine cranking system of claim 1 further comprising a running engine sensory component coupled between said system ground and said second control terminal of said first relay, wherein said running engine sensory component maintains said first relay in said closed-circuit position when said engine is operated in said running condition.

7. The engine cranking system of claim 6 wherein said running engine sensory component comprises a normally open oil pressure switch electrically coupled between said system ground and said second control terminal of said first relay, wherein said normally open oil pressure switch is positionable in a closed position in response to at least a predetermined minimum oil pressure being applied thereto.

8. The engine cranking system of claim 1 further comprising a third switch coupled between the first battery terminal and the first switch, said third switch moveable between at least an off position and a run position.

9. An engine cranking system comprising:

an engine;

a cranking motor coupled to said engine;

a battery coupled to said cranking motor and to a system ground;

a capacitor;

first and second electrical paths interconnecting said capacitor with said cranking motor and said system ground;

first and second switches;

a first relay included in one of said first or second electrical paths, wherein said first relay is moveable between at least a closed-circuit position, wherein said first relay completes said one of said first and second electrical paths, and an open-circuit position, wherein said first relay interrupts said one of said first and second electrical paths, and wherein said first switch is coupled between said first relay and said capacitor; and a second relay coupled to said second switch, wherein said second relay is moveable between at least a closed-circuit position, wherein said second relay completes a third electrical path activating said cranking motor, and an open-circuit position, wherein said second relay interrupts said third electrical path preventing cranking of said cranking motor.

10. The engine cranking system of claim 9 wherein said first relay is included in said second electrical path.

11. The engine cranking system of claim 9 wherein said first and second switches comprise a double pole, single-throw switch.

12. The engine cranking system of claim 11 wherein said double pole, single-throw switch comprises an ignition switch.

13. The engine cranking system of claim 9 further comprising a running engine sensory component coupled to said first relay, wherein said running engine sensory component maintains said first relay in said closed-circuit position when said engine is operated in said running condition.

14. The engine cranking system of claim 9 further comprising a running engine sensory component coupled between said system ground and said second control terminal of said first relay, wherein said running engine sensory component maintains said first relay in said closed-circuit position when said engine is operated in a running condition.

15. The engine cranking system of claim 14 wherein said running engine sensory component comprises a normally open oil pressure switch, wherein said normally open oil pressure switch is positionable in a closed position in response to at least a predetermined minimum oil pressure being applied thereto.

16. The engine cranking system of claim 9 further comprising a third switch coupled between said battery and said first switch, said third switch moveable between at least an off position and a run position.

17. The engine cranking system of claim 9 wherein each of said first and second switches are moveable between a closed position and an open position, wherein said first relay is moved to said closed-circuit position when said first switch is moved to said closed position, and wherein said second relay is moved to said closed-circuit position when said second switch is moved to said closed position.

18. A method for cranking an internal combustion engine comprising:

providing an engine cranking system comprising an engine, a cranking motor coupled to said engine, a battery coupled to said cranking motor and to a system ground, a capacitor, first and second electrical paths interconnecting said capacitor with said cranking motor and said system ground, first and second switches, a first relay included in one of said first or second electrical paths, wherein said first relay is moveable between at least a closed-circuit position and an open-circuit position, and wherein said first switch is coupled between said first relay and said capacitor, and a second relay coupled to said second switch, wherein said second relay is moveable between at least a closed-circuit position and an open-circuit position;

simultaneously closing said first and second switches;

applying a first control voltage to said first relay with said capacitor through said closed first switch;

positioning said first relay in said closed-circuit position in response to said first control voltage being applied thereto and thereby completing said one of said first and second electrical paths;

applying a second control voltage to said second relay through said closed second switch; and positioning said second relay in said closed-circuit position in response to said second control voltage being applied thereto.

19. The method of claim 18 wherein said first and second switches comprise a double pole, single-throw switch.

20. The method of claim 18 further comprising providing a running engine sensory component coupled to said first relay, sensing that said engine is in a running condition with said running engine sensory component, and maintaining said first relay in said closed-circuit position with said running engine sensory component.

21. The method of claim 20 wherein said running engine sensory component comprises a normally open oil pressure switch.

22. The method of claim 18 further comprising providing a third switch coupled between said battery and said second switch, said third switch moveable between at least one of an accessory and off position and a run position.

* * * * *